United States Patent [19]

Landqvist et al.

[11] Patent Number: 4,741,376

[45] Date of Patent: May 3, 1988

[54] MANUFACTURING OF KRAFT PAPER

[75] Inventors: Nils Landqvist, Gävle; Sven Spangenberg, Svärdsjö; Torsten Järnberg; Bengt Nordin, both of Gävle, Sweden

[73] Assignee: Korsnas Aktiebolag, Stockholm, Sweden

[21] Appl. No.: 833,418

[22] Filed: Feb. 21, 1986

Related U.S. Application Data

[63] Continuation of Ser. No. 593,954, Mar. 27, 1984, abandoned.

[30] Foreign Application Priority Data

Mar. 30, 1983 [SE] Sweden ..... 8301804

[51] Int. Cl.[4] ..... D21H 5/24

[52] U.S. Cl. ..... 162/111; 162/112; 162/113; 162/123; 162/132; 162/133; 162/204; 162/207

[58] Field of Search ..... 162/111, 112, 113, 109, 162/207, 205, 206, 123, 117, 133, 132, 204; 34/23, 156

[56] References Cited

U.S. PATENT DOCUMENTS

| | | | |
|---|---|---|---|
| 1,107,807 | 8/1914 | Loebbecke | 162/111 |
| 3,362,869 | 1/1968 | Welsh | 162/206 |
| 3,515,633 | 6/1970 | Futch | 162/206 |
| 3,523,865 | 8/1970 | Ihrman | 162/207 |

OTHER PUBLICATIONS

Casey, *Pulp and Paper*, vol. II, (1980), vol. III, (1983) pp. 1044–1052, 2360,2361.

*Primary Examiner*—Peter Chin
*Attorney, Agent, or Firm*—Marshall, O'Toole, Gerstein, Murray & Bicknell

[57] ABSTRACT

A process for manufacturing of kraft paper, especially kraft sack paper, on a multi-wire machine in which the web is dried by a combined cylinder drying and free drying and is optionally creped or micro-creped and optionally also glazed. By forming the web into two or more layers which are couched together in the wire part of the machine and subsequent shrinkage in order to obtain a stretch at break of at least 2.5% in the machine direction and of at least 5% in the tranverse direction, improved strength properties are provided.

15 Claims, No Drawings

MANUFACTURING OF KRAFT PAPER

This application is a continuation of application Ser. No. 593,954, filed Mar. 27, 1984, now abandoned.

The present invention refers to a new process for manufacturing of kraft paper, especially kraft sack paper, with improved strength properties.

The expression kraft paper refers to a high strength paper produced by sulphate pulp being either bleached or unbleached. Kraft paper of a grammage within the range 60–150 g/m$^2$, preferably 70–90 g/m$^2$, is normally suited for sack production.

Tests have shown that the strength of the paper sack in practical use, the so called service strength, is well correlated to the tensile energy absorption of a paper in the sack. The tensile energy absorption of a paper, that is, the total amount of work per unit of area which is required for a piece of paper to be stretched to rupture, is in turn, in addition to the breaking load, dependent on the stretch at break. An increased stretch at break will thus give a higher value for the tensile energy absorption. A kraft sack paper should consequently show high values for tensile energy absorption and stretch at break, especially in the cross direction where the largest stresses occur.

In order to increase the stretch at break, a paper web can be subjected to some kind of creping or micro-creping process. As an example of micro-creping the Clupak-process can be mentioned, in which the paper web is introduced between a roll and an endless rubber blanket, which is stretched before contacting the web and then contracted during the compression of the paper web. By this treatment the paper web will get an increased stretch at break above all in the machine direction at the same time as the surface remains smooth. In normal creping, however, a fine wrinkled paper web is obtained.

It is also known that the stretch at break of a paper increases during free drying, i.e. if the paper has the possibility to shrink freely during drying. This can be achieved by so called fan drying of a paper web, the web being supported by a hot air stream which enables a stress-free drying.

Such an effect is also achieved with so called high velocity air hoods, as well as with so called "air glide cylinders". In the former case hot air is blown from above on a web, which runs along with the surface of the drying cylinder and in the latter case the paper web is free floating by hot air being blown in under the paper web through nozzles in a convex surface above which the paper web is moving. By this the paper obtains a high stretch at break, especially in the cross direction, compared to paper dried on heated cylinders in a conventional way. The tensile energy absorption and the tearing resistance are also improved at the same time as the paper becomes more bulky and the surface thereof a little coarser.

These conditions have been utilized within industry for making sack paper of high strength. In the commercial production of kraft paper a combined cylinder drying and fan drying of a homogeneous paper web has been used. In this manner it is possible to vary the drying conditions and so the properties of the paper.

The present invention relates to a process for preparing kraft paper on a multi-wire machine, wherein a multi-layer web is dried preferably by a combined cylinder drying and fan drying and the web is optionally micro-creped or creped and optionally glazed.

The expression micro-creping refers to a mechanically forced shrinkage of the paper web having a creped structure almost invisible to the eye, for instance, performed by a Clupak-aggregate.

The expression creping refers to creping on a roll against a doctor blade, whereupon the creped structure appears more distinctly.

It has now been found that a kraft paper having surprisingly high strength properties is obtained if the paper web in the stated process is formed into two or more layers, which are couched together in the wire section of the machine and then shrunk in order to obtain a stretch at break of at least 2.5% in the machine direction and of at least 5% in the cross direction.

The process of the invention has not been used before or the effect thereof indicated. In laboratory tests, as well as in technical scale, the positive effect of free drying of a homogeneous web on the tensile energy absorption of the paper, however, has been documented before. In laboratory experiments by applicants to determine the effect of making a web of kraft paper in two layers instead of one layer at a constant grammage, no improved effect has been shown. This has been applicable to conventionally dried laboratory sheets as well as to free dried laboratory sheets.

It is known that a smaller, positive effect on the tensile energy absorption can be achieved when the paper is produced in two layers instead of in one layer in a paper machine. The effect, however, has been of little practical consequence and has not been commercially utilized with regard to kraft paper.

Kraft paper prepared according to the invention shows quite unexpectedly substantially improved strength properties compared to both homogeneous sheets, which have been dried freely in an air supported web, and two or multi-layer sheets, which have been conventionally dried on cylinders. The improvement attained is larger than what could be expected and especially pronounced in the cross direction of the paper, which is of great importance in the production of paper sacks and paper bags of different kinds.

The process of the invention can, thus, be used for preparing kraft paper having high strength properties from normal high quality soft wood sulphate pulp.

Alternatively, the process of the invention can be used to prepare kraft paper having conventional strength properties, either from high quality starting material of a lower grammage, or of stock of a lower quality, for instance, consisting of high yield fibers or slushed waste paper.

A reduction of the raw material requirements is of great importance to enable kraft paper to successfully compete with other packing materials, such as plastic film, plastic fabric and different combinations of materials.

By the new process it will be possible to use different paper making pulps for the different layers. A bleached or colored pulp might, for instance, be used as a starting material for an upper layer and an unbleached pulp for a lower layer.

In order to achieve the required strength paper sacks are normally produced from two or more sheets which are pasted together. By means of kraft paper prepared according to the new process it will be possible to produce sacks from one sheet having the same strength. By this process a considerable simplification of the paper sack production is obtained, which in combination with the reduced material consumption, leads to significant economical advantages.

In order to obtain a shrinkage of the paper web corresponding to a stretch at break of at least 2.5% in the machine direction and of at least 5% in the cross direction, free drying is utilized, preferably within the dry solids content range of 55–85% by weight. The part of the drying which takes place by free drying can vary, but generally the larger the part being performed as free drying the higher the strength of the paper product. The part of the drying which is not performed freely is accomplished on ordinary steam heated drying cylinders.

In accordance with a special mode of the process of the invention the free drying of the paper web is combined with creping or micro-creping in order to obtain a stretch at break in the machine direction of 3–12%, preferably 5–7%. The creping can be performed as wet creping in the press section of the machine after couching the layers. Micro-creping, which might, for instance, be performed in a Clupak-aggregate, can be performed after couching and pressing but before the free drying. By this, very large improvements of the stretch compared to conventional techniques are obtained.

According to another mode of the process of the invention, the paper web, at a dry solids content of 70–80% by weight, preferably 75% by weight, can be glazed during the free drying. In this case the paper web, after partial drying, can be removed from the zone of free drying, brought to pass one or more smoothing machine nips, and then reintroduced into the zone of free drying until an adequate dry solids content is obtained. The glazing provides a high strength in the z-direction of the paper, so called internal bond strength, even higher values than for paper prepared in one layer in a conventional way. A paper which has been prepared and glazed according to the new process is well suited for surface conditioning, for instance, coating to qualities for qualified printing.

The invention is disclosed more in detail by means of the following examples.

EXAMPLE 1

The purpose of this example is to show which changes could be expected in kraft paper being made from two layers instead of one layer.

Unbleached sulphate pulping was refined in a PFI-mill to 22° SR in the laboratory.

Laboratory sheets were prepared according to the standard method SCAN-C 26:67 with the following deviations.

Homogeneous sheets (one-layer sheets) were prepared with a grammage of 100 g/m$^2$ (60 g/m$^2$ according to the standard). Half the number of sheets were dried in accordance with the standard, the sheets being fastened on a drying drum to prevent shrinkage. The other half of the sheets were dried freely between blotters being allowed to shrink without hindrance.

The two-layer sheets were prepared by couching two sheets each having a grammage of 50 g/m$^2$ (together 100 g/m$^2$ as the one-layer sheets). Half the number of sheets were dried in accordance with the standard with the sheets fastened on a dryer drum to prevent shrinkage. The other half of the sheets were dried freely between blotters being allowed to shrink without hindrance.

The results from the strength tests are given in Table 1.

TABLE 1

| | Sheet Composition: | | | |
|---|---|---|---|---|
| | Homogeneous Sheet-One Layer | | Two Layers | |
| | Drying: | | | |
| | Without Shrinkage | With Free Shrinkage | Without Shrinkage | With Free Shrinkage |
| Tensile index Nm/g | 98.2 | 92.8 | 102.1 | 92.7 |
| Stretch at break, % | 3.8 | 6.1 | 3.8 | 5.7 |
| Tensile energy absorption index, mJ/g | 2400 | 3260 | 2420 | 3080 |
| Relative tensile energy absorption index, % | 100 | 136 | 101 | 128 |

The conclusion to be drawn by this laboratory test is that almost the same results are obtained with two-layer sheets and with homogeneous sheets and that the free shrinkage has a positive effect on the strength.

EXAMPLE 2

The purpose of this example is to illustrate the difference between a conventional sheet made in one layer and a sheet formed from two layers and freely dried.

The tests were performed as tests in a technical scale, wherein a paper machine provided with two wires and a fan dryer for free drying was run with the grammage 100 g/m$^2$ in the production of homogeneous sheets (only one wire is used) with and without fan dryer as well as in the production of two-layer sheets of 2×50 g/m$^2$ with fan dryer, in all cases, at a constant machine rate and from the same stock of unbleached kraft pulp.

The results from the strength tests are given in Table 2.

TABLE 2

| Results from testing of sheets with a grammage of 100 g/m$^2$ produced on a paper machine. | | | | |
|---|---|---|---|---|
| | | Conv. Dried Homogeneous Sheet | Freely Dried Homogeneous Sheet | Freely Dried Two-Layer Sheet |
| Tensile index | L Nm/g | 85 | 78 | 115 |
| | T Nm/g | 50 | 46 | 52 |
| Stretch | L % | 2.6 | 3.5 | 3.5 |

TABLE 2-continued

| Results from testing of sheets with a grammage of 100 g/m² produced on a paper machine. | | | | |
|---|---|---|---|---|
| | | Conv. Dried Homogeneous Sheet | Freely Dried Homogeneous Sheet | Freely Dried Two-Layer Sheet |
| | T % | 4.7 | 6.5 | 8.9 |
| Tensile energy absorption index | L J/g | 1.5 | 1.7 | 2.5 |
| | T J/g | 1.7 | 2.0 | 3.0 |
| | $\frac{L+T}{2}$ J/g | 1.6 | 1.85 | 2.75 |
| Relative tensile energy absorption index | | 100 | 115 | 172 |

L = machine (longitudinal) direction, T = cross direction

All strength properties of importance, tensile index, stretch and tensile energy absorption index are increased according to the process of two layers combined with free drying. The free drying has, compared to conventional cylinder drying for homogeneous sheets given, a positive effect on the tensile energy absorption index of 15%, counted as the average value of the tensile energy absorption index in the machine and transverse direction. Two layer forming combined with free drying gives, compared to a conventionally dried homogeneous sheet, an improved strength of 72% or about 5 times larger than what is obtained in free drying of homogeneous sheets.

This example, thus, shows that a very strong improvement of the paper properties is obtained when the paper is produced in accordance with the invention. This effect is very surprising and was not predicted by the laboratory tests in Example 1.

We claim:

1. A process for manufacturing high strength kraft sack or bag paper having improved tensile energy absorption, comprising:

forming on a paper machine at least two separate moist layers of kraft sack or bag paper pulp;

couching said layers together and pressing to form a single pressed web; and drying said pressed web partly by free drying and partly by cylinder drying, the part of the drying performed by said free drying being within a dry solids content range of from about 55% to about 85% by weight and permitting sufficient free shrinkage of the web to provide substantially increased stretch at break in the cross direction, and the part of said drying not performed by free drying being performed by cylinder drying.

2. A process as in claim 1, wherein during said free drying the web is glazed by passing through one or more glazing nips.

3. A high strength kraft sack or bag paper having improved strength properties as manufactured by the process of claim 1.

4. A process for manufacturing high strength kraft sack or bag paper having improved tensile energy absorption, comprising:

forming on a paper machine at least two separate moist layers of kraft sack or bag paper pulp;

couching said layers together and pressing to form a single pressed web;

drying said pressed web partly by free drying and partly by cylinder drying, the part of the drying performed by said free drying being within a dry solids content range of from about 55% to about 85% by weight and permitting sufficient free shrinkage of the web to provide substantially increased stretch at break in the cross direction, and the part of said drying not performed by free drying being performed by cylinder drying; and creping or micro-creping said web before said free drying.

5. A process as in claim 1 or claim 4, wherein the amounts of said pulp layers are sufficient to provide a paper grammage within the range of from about 60 to about 150 g/m².

6. A process as in claim 1 or claim 4, wherein the resultant kraft sack or bag paper has a stretch at break in the machine direction of at least about 2.5% and a stretch at break in the cross direction of at least about 5%.

7. A process as in claim 4, wherein the resultant kraft sack or bag paper has a stretch at break in the machine direction of from about 3% to about 12%.

8. A process as in claim 1, wherein said pressed web is partially dried by cylinder drying, the partially dried web is micro-creped, and the drying of said web is completed first by free drying within a dry solids content range of from about 55% to about 85% by weight and finally by cylinder drying.

9. A process as in claim 1 or claim 4, wherein said free drying is effected in a fan dryer.

10. A high strength kraft sack or bag paper having improved strength properties as manufactured by the process of claim 4.

11. A high strength kraft sack or bag paper having a grammage of about 100 g/m² and a tensile energy absorption index of about 3 J/g in the cross direction as manufactured by the process of claim 4.

12. A process as in claim 1 or claim 4, wherein said pulp layers are formed on a multi-wire paper machine with each layer supported on its own wire.

13. A process as in claim 1 or claim 4, wherein said free drying is effected by blowing a stream of hot air onto said web while said web is suspended or supported in air.

14. A process as in claim 4, wherein said paper machine has wire, press, and drying sections, and after said layers are couched together the web is wet creped in the press section of the machine.

15. A process as in claim 1 or claim 4, wherein said pressed web is partially dried by cylinder drying, and the drying of said web is completed first by free drying within a dry solids content range of from about 55% to about 85% by weight and finally by cylinder drying.

* * * * *